United States Patent [19]

Tate, Jr.

[11] Patent Number: 4,525,003

[45] Date of Patent: Jun. 25, 1985

[54] KNOTTING DEVICE

[76] Inventor: John L. Tate, Jr., Rte. 8, Box 464, Denham Springs, La. 70726

[21] Appl. No.: 574,058

[22] Filed: Jan. 26, 1984

[51] Int. Cl.[3] ..... B65H 69/04

[52] U.S. Cl. ..... 289/17

[58] Field of Search ..... 289/17

[56] References Cited

U.S. PATENT DOCUMENTS

| | | | |
|---|---|---|---|
| 1,349,659 | 8/1920 | Brown | 289/17 |
| 2,601,605 | 6/1952 | Fulvio | 289/17 |
| 2,700,840 | 2/1955 | Butts | 289/17 |
| 2,899,226 | 8/1959 | Lint | 289/17 |
| 3,086,802 | 4/1963 | Keeton | 289/17 |

*Primary Examiner*—Louis K. Rimrodt

*Attorney, Agent, or Firm*—E. E. Spielman, Jr.

[57] ABSTRACT

This invention relates to a knotting device which comprises a handle portion, an elongated rod affixed to the handle portion and an elongated member movably mounted to the handle portion. A knot is initially engaged so that it can be slipped and tightened on the rod. The elongated member engages the free tail of the knot and moves it off of the rod so that final tightening can occur with the knot still engaged with the elongated member.

20 Claims, 11 Drawing Figures

KNOTTING DEVICE

BACKGROUND OF THE INVENTION

The manufacture of articles such as necklaces, bracelets, belts, etc., by stringing beads onto a length of twine is probably as old as civilization. In its simplest form such manufacture only requires the placement of a hole through each bead and the stringing of the beads onto twine of selected length. A clasp at or the simple knotting of the terminal ends of the twine is used to connect the ends to one another to complete the article.

Generally, the twine utilized is of small diameter so that its presence in the article is hidden or is at least not prominent—the real prominence being reserved to show off the beads. The use of small diameter twine, while aesthetically desirable, is not without functional limitation since the smaller the twine diameter the less its breaking strength. Thus, consideration has to be given to the strength of the twine so that it will not be easily broken under expected stress when worn by the wearer. The compromise between twine diameter and twine strength, however, is easily resolved in the direction most important to the manufacturer. Even with the desired compromise being made, twine breakage has and still occurs. If the beads are merely strung onto the twine without further precaution, twine breakage results in the beads falling from the string and being damaged or lost. If the beads are of material of little value, such as plastic or glass, damage to or loss of the beads is tolerable. However, should the beads be of a semi-precious stone, pearl or the like, damage and loss is not tolerable and precaution against such an occurence has to be provided for.

It is well known that such precaution can be obtained by the simple expedient of knotting the twine before and after each bead. The knot size is, of course, larger than the diameter of the hole in the bead. To simplify the assembly of a knotted string of beads, the bead hole diameter is caused to be rather constant. Still, however, the knotting technique is time consuming and expensive—this being especially true when the knotting is done by hand. Hand knotting requires concentration to details such as uniformity in knot size and knot placement. Achieving uniformity in knot size is made somewhat difficult due to oils in the knotter's hands being transferred to the twine as the knot is pushed tight by the knotter's thumb nail and forefinger. The transferred oils changes the twine's knot slipping characteristics thereby introducing variability in the tension on the twine needed to slip and form the final knot.

To provide speed and fidelity of knot formation in twine, it is an object of this invention to provide a knotting device which quickly slips and forms a knot with minimization of hand contact with the twine.

THE INVENTION

This invention relates to a knotting device for slipping and finally tightenting a loosely tied knot. The device comprises a handle portion which is configued to comfortably rest in the human hand. The handle portion can be of any suitable material for example wood, plastic, metal, etc. Attached to one end of the handle portion is a rod which is preferably resiliently flexible. This rod can be made of metal or an engineering thermoplastic. Attachment of the rod to the handle portion is easily achieved by tightly nesting the proximate portion of the rod in a rod bore drilled within the handle portion. It is preferred that the distal portion of the rod be tapered so that it terminates into a point or at least a near point. Further, the rod can be bent to provide a slight obtuse angle so that the distal end of the rod will be in closer proximity to an elongated member which is movably mounted to the handle portion. The movable mounting of the elongated member is achieved by providing a second bore in the handle portion for receipt of the proximate portion of the elongated member. It is also preferred that the axes of the rod bore and the second bore be substantially parallel to each other. Provision of the before-mentioned movable mounting of the elongated member allows for its rearward and forward movement with respect to the handle portion. This movement, at its extremes, will place the distal end of said elongated member rearward of and forward of the distal end of said rod. In a highly preferred form of this invention the elongated member can be spring loaded within the handle portion so that the elongated member is biased to a rearward most position. In this rearward most postion the distal portion of the elongated member will not extend past the distal end of the rod. It has also been found convenient to provide a thumb plate on the elongated member to aid in moving the elongated member to its forward most extent.

At the distal end of the elongated member there is additionally provided a forked portion having a knot recess at it's crotch. In one embodiment of this invention the forked portion is facing in a direction away from the handle portion. In a second embodiment the forked portion comprises two forks which are spacedly and oppositely opposed to one another. In this embodiment one fork faces away from the handle portion while the other fork faces towards the handle portion. In a third embodiment of this invention the forked portion is oriented so that the open end of the forked portion faces toward the handle portion.

In operation the knotting device of this invention is the paragon of simplicity. When tightening an overhand knot for example, the end of the rod is passed into the major loop portion of the knot. The free tail of the knot is pulled to initially tighten the knot on the rod. The elongated member is then moved forward so that the fork portion engages the free tail of the knot. The movement of the elongated member places the crotch of the forked portion at a point beyond the distal end of the rod to effect removal of the knot from the rod. The flexibility of the rod and the stress from the pulling on the free tail will cause the rod to bend upward slightly so that the movement of the elongated member is along a path which is in closing relationship with the distal end of the rod. Once the initially tightened knot is removed from the rod it achieves a nesting position within the recess found at the crotch of the forked portion. It is here that final tightening occurs. The depth and taper of the recess will determine the final position of the knot with respect to the previously strung bead. Preferably, the recess is provided with a tapered portion which extends rearwardly and downwardly from the crotch. It has been found that when stringing 3 to 6 mm sized pearls that the recess should have a depth of from about 1/32 to about 1/64 of an inch and the taper should be approximately from about 1/16 to about 3/32 of an inch long with the taper extending from the crotch to the bottom side of the forked portion. After the knot has been tightened to the user's specification the free tail of the knot is removed from the crotch.

These and other features of this invention contributing to satisfaction in use and economy in manufacture will be more fully understood from the following description and the accompanying drawings in which.

Figure 1:
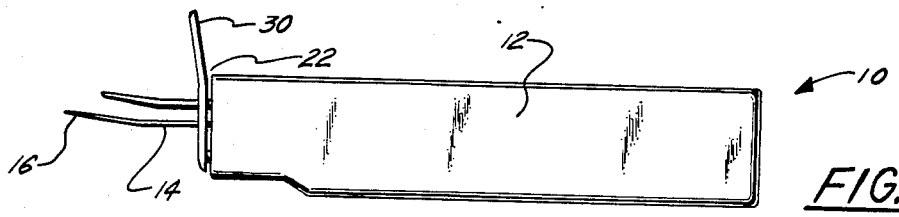
FIG. 1 is a side elevational view of an embodiment of this invention.
Figure 2:
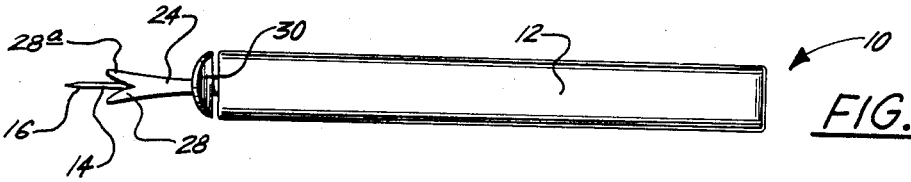
FIG. 2 is a top plan view of the embodiment shown in FIG. 1.
Figure 3:
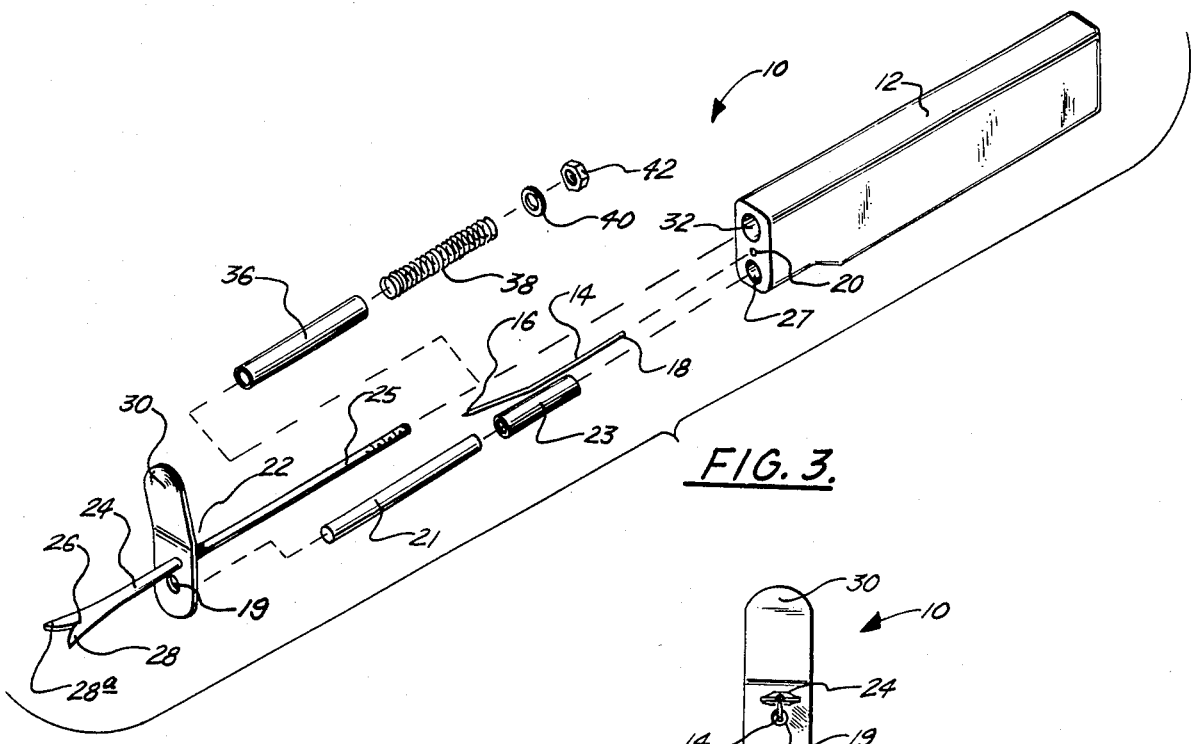
FIG. 3 is an exploded view of the embodiment shown in FIG. 1.
Figure 4:
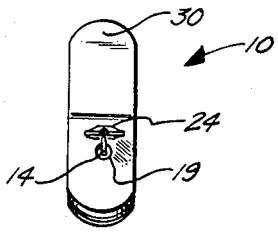
FIG. 4 is an end plan view of the embodiment shown in FIG. 1.

Referring now to FIGS. 1–4 and 9–11 there can be seen a knotting device of this invention generally designated by the numeral 10. As can be seen in the Figures knotting device 10 has a handle portion 12 into which there are drilled three bores, i.e. rod bore 20, second bore 32 and third bore 27. The second bore 32 extends into handle portion 12. Snugly fitted within second bore 32 is bushing 36. As can be seen in FIG. 3 spring element 38 is also fitted into second bore 32 and is dimensioned so that it will be in abutment with bushing 36. The total length of bushing 36 and spring element 38 is preferably approximate the length of second bore 32.

Slidably fitted within the bore of bushing 36 is the proximate portion 25 of elongated member 22. Proximate portion 25 will also fit through the center of spring element 38. Once so fitted, washer 40 is placed on the threaded end of proximate portion 25 and nut 42 is threaded thereon. As can be appreciated since bushing 36 is snugly fit within second bore 32, any forward movement of elongated member 22 from second bore 32 results in compression of spring 38.

Figures 5, 6, 7, 8:
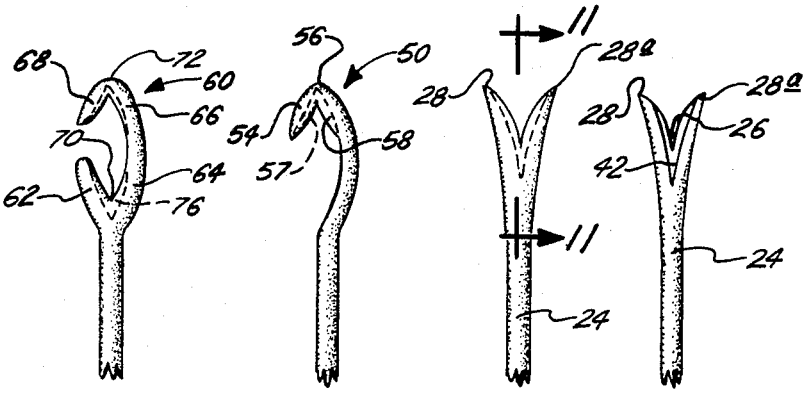
FIG. 5 is a forked portion of this invention.
FIG. 6 is another forked portion of this invention.
FIG. 7 is another forked portion of this invention.
FIG. 8 is a bottom view of the forked portion shown in FIG. 7.
Figure 11:
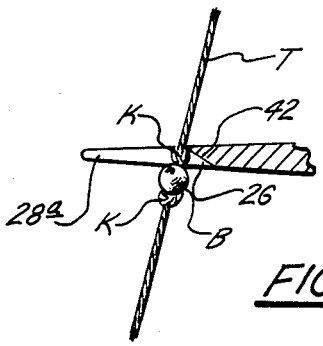
FIG. 11 is an enlarged view of the forked portion shown in FIG. 7 with a knot nested within the recess.

Elongated member 22, for the embodiment shown in the drawings, has push plate 30 affixed thereto. This push plate is configured and dimensioned so that the thumb of the user of the knotting device of this invention can easily push against push plate 30 to achieve the forward motion of elongated member 22. At the distal portion of elongated member 22 is a forked portion 24. For the embodiment shown in the drawings forked portion 24 has relatively flat upper and lower surfaces. Forked portion 24 has a forked end defined by crotch 26 and forked fingers 28 and 28*a*. As can be seen in FIGS. 7, 8 and 11 forked portion 24 is provided with a recess 42. Recess 42 is, at its deepest depth, at crotch 26 and tapers downwardly and outwardly towards the lower surface of forked portion 24. The taper, as can be seen in FIGS. 7 and 8 also extends along substantially the entire length of fork fingers 28 and 28*a*.

Fixedly mounted within rod bore 20 is rod 14. Rod 14 has its proximate end inserted within rod bore 20 so that it will be snugly fitted. Rod 14 is slightly bent to form an obtuse angle in the manner shown in FIGS. 1 and 3. As also can be seen in these Figures rod 14 has a slight taper so that the distal portion terminates in a pointed distal end 16.

Within third bore 27 is snugly fitted bushing 23. Slidably mounted within bushing 23 is shaft 21. Shaft 21 is fixedly attached to aperature 19 in push plate 30. By providing the attachment of shaft 21 to push plate 30 the path and orientation of elongaged element 22 is assured.

In FIG. 5 a second form of the forked portion is shown and is generally designated by the numberal 60. Forked portion 60 has two forks which are oppositely opposed and spaced from one another. The first is designated by the numeral 70 while the second is designated by the numeral 72. Fork 70 has two forked fingers 62 and 64 while fork 72 has forked fingers 68 and 66. Forked fingers 66 and 64 are joined one to the other as can be seen in FIG. 5. Forked fingers 62 and 68 are not, however, connected one to the other thus a space is provided through which the free tail of a knot can be passed so that the user of the knotting device of this invention can apply tightening pressure to the knot. When fork 70 is utilized the free tail of the knot will be pulled towards the user, while, when fork 72 is utilized, the free tail of the knot will be pulled away from the user.

In FIG. 6 a third fork portion of this invention is shown and is generally designated by the numeral 50. Fork 56 comprises fork finger 54 and fork finger 58. In this configuration forked portion 50 allows for the user to achieve knot removal from rod 14 and knot tightening by pulling the free tail of the knot away from them. Also elongated member 22 is prevented from forward movement by the users finger holding push plate 30 until the initial knot tightening has been completed on rod 14. (This same technique is used when fork 72 of FIG. 5 is used.)

In both of the cases in FIGS. 5 and 6 the recesses are shown in dotted line and are designated by the numerals 76 and 57, respectively. Configuration of these recesses is identical to or very similar to the recess 42 described for the embodiment shown in FIGS. 1–4 and 7–11.

Figure 9:
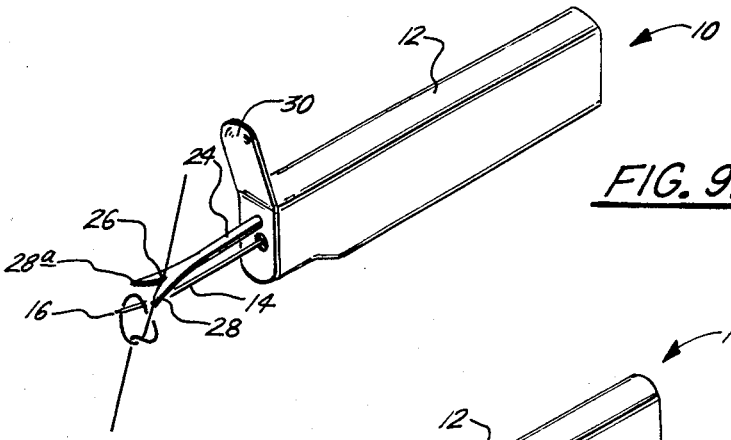
FIG. 9 is a perspective view of the embodiment shown in FIG. 1 wherein the rod has initially engaged the major loop of an overhand knot.
Figure 10:
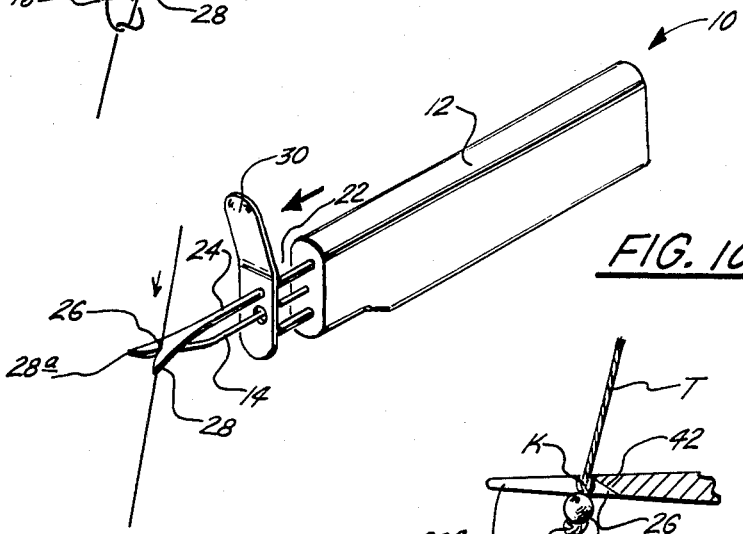
FIG. 10 is a perspective view of the embodiment shown in FIG. 1 showing the elongated member being moved forwardly to remove the knot from the rod.

In use, knotting device 10 is uncomplicated. As seen in FIG. 9 the major loop portion of an overhand knot is entered by the distal end 16 of rod 14. The user then places tension on the free tail of the knot so that the knot is tightened about rod 14. At this point elongated member 22 is moved forwardly out of handle portion 12 by pressure on push plate 30 by the user's thumb. Also note that the free tail of the knot is captured at the crotch 26 of forked portion 24. Continued movement of elongated member 22 will cause the knot to be pushed off of the distal end 16 of rod 14 so that it nests within crotch 26 as seen in FIG. 11. Also during this removal period rod 14 will be bent slightly upwardly so that the path of elongated member 22 is in approximate closing relationship with the distal end 16 of rod 14. In FIG. 11 bead B has been previously threaded onto twine T at a position above knot $K_a$. The knot presently being formed, $K_b$, has been slipped and has achieved an initial tightening on rod 14. As can be appreciated from the drawing the width of recess 42 will determine how deep into the recess bead B is allowed to enter. If bead B is totally kept from the recess then knot $K_b$ will be tightened away from bead B. If it is desired to have knot $K_b$ tightened in abutting relationship with bead B then recess 42 will have to be widened. Thus, by simple trial and error the user of the device of this invention can, according to the size of beads involved, adjust the knot position by varying the width of recess 42. Further, the diameter of knot $K_b$, which is directly proportional to the amount of tension applied to the free tail end of the knot, can be adjusted by the amount of tension placed on the free tail when knot $K_b$ is nested in the recess.

What is claimed is:

1. A knotting device which comprises:

(a) a handle portion;

(b) an elongated resiliently flexible rod attached at its proximate end to said handle portion, said rod having a taper to at least a near-point at its distal end; and (c) an elongated member movably mounted to said handle portion whereby the distal end of said elongated member travels along a path which extends from a point rearward of to a point forward of said distal end of said rod, said distal end of said elongated member having a forked portion which includes a knot recess at its crotch.

2. The knotting device of claim 1 wherein said distal end of said rod comes to a point.

3. The knotting device of claim 1 wherein said rod is bent to an obtuse angle at a point adjacent its distal end and in a direction towards said elongated member.

4. The knotting device of claim 1 wherein said forked portion has a flat side into which said knot recess extends.

5. The knotting device of claim 1 wherein there is additionally provided a push plate fixedly attached to said elongated member at a point rearwardly of its said distal end.

6. The knotting device of claim 5 wherein said thumb plated has an aperature through which a portion of said rod passes.

7. The knotting device of claim 1 wherein said forked portion opens in a direction opposite the direction towards said handle portion and wherein said knot recess has a depth within the range of from about 1/64 to about 1/32 inches at said crotch and said knot recess is tapered downwardly and rearwardly from said crotch for a distance within the range of from about 1/16 to about 3/32 inches.

8. The knotting device of claim 1 wherein said knot recess has a depth within the range of from about 1/64 to about 1/32 inches.

9. The knotting device of claim 1 wherein said forked portion has two forks spacedly and oppositely opposed to one another.

10. The knotting device of claim 1 wherein said forked portion opens in direction towards said handle portion.

11. The knotting device of claim 1 wherein said forked portion opens in a direction opposite the direction towards said handle portion and wherein said knot recess extends in a downwardly tapered manner rearwardly of said crotch and extends in a downward and forward taper from said crotch along the inside length of each fork finger.

12. The knotting device of claim 11 wherein said rod is bent to an obtuse angle at a point adjacent its distal end in a direction toward said moving means.

13. A knotting device for slipping and finally tightening an overhand knot from a loosly tied overhand knot, said device comprising:

(a) a handle portion;

(b) an elongated means fixedly attached to said handle portion for extending into the major open loop of said loosely tied overhand knot, said elongated means providing a point about which said loosely tied overhand knot can be initially tightened; and (c) moving means movably mounted to said handle portion whereby said moving means can be moved to engage the free tail of the overhand knot subsequent to its said initial tightening on said elongated means and to move the initially tightened overhand knot off of said elongated means, said moving means includes, at its distal end, a portion having an open end and a closed end for said engaging and a knot recess at said closed end for nesting of the initially tightened overhand knot after its movement off of said elongated means so that optional final tightening can occur.

14. The knotting device of claim 13 wherein said portion is a two prong fork with said closed end being located at the crotch of said two prong fork.

15. The knotting device of claim 14 wherein said two prong fork has a flat side into which said knot, recess extends.

16. The knotting device of claim 14 wherein said closed end opens in a direction toward said handle portion.

17. The knotting device of claim 14 wherein said open end opens in a direction opposite the direction towards said handle portion and wherein said knot recess has a depth within the range of from about 1/64 to about 1/32 inches at said crotch and said knot recess is tapered downwardly and rearwardly from said crotch for a distance with range of from about 1/16 to about 3/32 inches.

18. The knotting device of claim 13 wherein said elongated means is a rod attached at its proximate end to said handle portion and has a taper to at least a near point, which point is located at the distal end of said rod.

19. The knotting device of claim 13 wherein said moving means is movably mounted to said handle portion whereby the distal end of said moving means travels along a path which extends from a point rearward to a point forward of the distal end of said elongated means.

20. The knotting device of claim 13 wherein said portion is two two pronged forks which are spaced from and oppositely opposed to one another.

* * * * *